US007750728B2

(12) United States Patent
Marinca

(10) Patent No.: US 7,750,728 B2
(45) Date of Patent: Jul. 6, 2010

(54) REFERENCE VOLTAGE CIRCUIT

(75) Inventor: Stefan Marinca, Dooradoyle (IE)

(73) Assignee: Analog Devices, Inc., Norwood, MA (US)

( * ) Notice: Subject to any disclaimer, the term of this patent is extended or adjusted under 35 U.S.C. 154(b) by 0 days.

(21) Appl. No.: 12/054,856

(22) Filed: Mar. 25, 2008

(65) Prior Publication Data

US 2009/0243713 A1 Oct. 1, 2009

(51) Int. Cl.
*G05F 3/02* (2006.01)

(52) U.S. Cl. ..... 327/539; 327/512; 327/513

(58) Field of Classification Search ..... 327/539
See application file for complete search history.

(56) References Cited

U.S. PATENT DOCUMENTS

| | | | |
|---|---|---|---|
| 4,399,398 | A | 8/1983 | Wittlinger |
| 4,475,103 | A | 10/1984 | Brokaw et al. |
| 4,603,291 | A | 7/1986 | Nelson |
| 4,714,872 | A | 12/1987 | Traa |
| 4,800,339 | A | 1/1989 | Tanimoto et al. |
| 4,808,908 | A | 2/1989 | Lewis et al. |
| 4,939,442 | A | 7/1990 | Carvajal et al. |
| 5,053,640 | A | 10/1991 | Yum |
| 5,119,015 | A | 6/1992 | Watanabe |
| 5,229,711 | A | 7/1993 | Inoue |
| 5,325,045 | A | 6/1994 | Sundby |
| 5,352,973 | A | 10/1994 | Audy |
| 5,371,032 | A | 12/1994 | Nishihara |
| 5,424,628 | A | 6/1995 | Nguyen |
| 5,512,817 | A | 4/1996 | Nagaraj |
| 5,563,504 | A | 10/1996 | Gilbert et al. |

(Continued)

FOREIGN PATENT DOCUMENTS

| | | |
|---|---|---|
| EP | 0510530 | 10/1992 |

(Continued)

OTHER PUBLICATIONS

PCT/EP2008/067402 International Search Report, Mar. 20, 2009.

(Continued)

*Primary Examiner*—Lincoln Donovan
*Assistant Examiner*—Khareem E Almo
(74) *Attorney, Agent, or Firm*—Kenyon & Kenyon LLP

(57) ABSTRACT

A reference voltage circuit which is less dependent on semiconductor process variations compared to bandgap based reference voltage circuits. The circuit comprises a first amplifier having an inverting input, a non-inverting input and an output. A current biasing circuit provides first and second PTAT currents, and a CTAT current. The CTAT current is equal in value to the second PTAT at a first predetermined temperature and opposite in polarity. A first load element is coupled to the non-inverting input of the first amplifier and arranged for receiving the first PTAT current such that a PTAT voltage is developed across the first load element. A feedback load element is coupled between the inverting input and the output of the amplifier for receiving the summation of the CTAT current and the second PTAT current. The feedback load element is such that at a second predetermined temperature the voltage at the output of the amplifier is substantially equal to the voltage at the output of the amplifier at the first temperature.

24 Claims, 5 Drawing Sheets

U.S. PATENT DOCUMENTS 5,646,518 A 7/1997 Lakshmikumar et al.
5,821,807 A 10/1998 Brooks
5,828,329 A 10/1998 Burns
5,933,045 A 8/1999 Audy et al.
5,952,873 A 9/1999 Rincon-Mora
5,982,201 A 11/1999 Brokaw et al.
6,002,293 A 12/1999 Brokaw
6,075,354 A 6/2000 Smith et al.
6,157,245 A 12/2000 Rincon-Mora
6,218,822 B1 4/2001 MacQuigg
6,225,796 B1 5/2001 Nguyen
6,255,807 B1 7/2001 Doorenbos et al.
6,329,804 B1 12/2001 Mercer
6,329,868 B1 12/2001 Furman
6,356,161 B1 3/2002 Nolan et al.
6,362,612 B1 3/2002 Harris
6,373,330 B1 4/2002 Holloway
6,426,669 B1 7/2002 Friedman et al.
6,462,625 B2 10/2002 Kim
6,483,372 B1 11/2002 Bowers
6,489,787 B1 12/2002 McFadden
6,489,835 B1 12/2002 Yu et al.
6,501,256 B1 12/2002 Jaussi et al.
6,529,066 B1 3/2003 Guenot et al.
6,531,857 B2 3/2003 Ju
6,549,072 B1 4/2003 Vernon
6,590,372 B1 7/2003 Wiles, Jr.
6,614,209 B1 9/2003 Gregoire, Jr.
6,642,699 B1 11/2003 Gregoire, Jr.
6,661,713 B1 12/2003 Kuo
6,664,847 B1 12/2003 Ye
6,690,228 B1 2/2004 Chen et al.
6,791,307 B2 9/2004 Harrison
6,798,286 B2 9/2004 Dauphinee et al.
6,801,095 B2 10/2004 Renninger, II
6,828,847 B1 12/2004 Marinca
6,836,160 B2 12/2004 Li
6,853,238 B1 2/2005 Dempsey et al.
6,885,178 B2 4/2005 Marinca
6,891,358 B2 5/2005 Marinca
6,894,544 B2 5/2005 Gubbins
6,919,753 B2 7/2005 Wang et al.
6,930,538 B2 8/2005 Chatal
6,958,643 B2 10/2005 Rosenthal
6,987,416 B2 1/2006 Ker et al.
6,992,533 B2 1/2006 Hollinger et al.
7,012,416 B2 3/2006 Marinca
7,057,444 B2 6/2006 Illegems
7,068,100 B2 6/2006 Dauphinee et al.
7,088,085 B2 8/2006 Marinca
7,091,761 B2 8/2006 Stark
7,112,948 B2 * 9/2006 Daly et al. ..... 323/316
7,170,336 B2 1/2007 Hsu
7,173,407 B2 2/2007 Marinca
7,193,454 B1 * 3/2007 Marinca ..... 327/539
7,199,646 B1 4/2007 Zupcau et al.
7,211,993 B2 5/2007 Marinca
7,224,210 B2 5/2007 Garlapati et al.
7,236,047 B2 6/2007 Tachibana et al.
7,248,098 B1 7/2007 Teo
7,260,377 B2 8/2007 Burns et al.
7,301,321 B1 11/2007 Uang et al.
7,372,244 B2 5/2008 Marinca
7,411,380 B2 8/2008 Chang et al.
7,472,030 B2 12/2008 Scheuerlein
7,482,798 B2 1/2009 Han
2003/0234638 A1 12/2003 Eshraghi et al.
2005/0073290 A1 4/2005 Marinca et al.
2005/0122091 A1 6/2005 Marinca
2005/0151528 A1 7/2005 Marinca
2005/0168207 A1 8/2005 Daly et al.
2005/0194957 A1 9/2005 Brokaw
2005/0237045 A1 10/2005 Lee et al.
2006/0017457 A1 1/2006 Pan et al.
2006/0038608 A1 2/2006 Ozawa
2007/0176591 A1 8/2007 Kimura
2008/0018319 A1 1/2008 Chang et al.
2008/0074172 A1 3/2008 Marinca
2008/0224759 A1 9/2008 Marinca
2008/0265860 A1 10/2008 Dempsey et al.

FOREIGN PATENT DOCUMENTS

EP 1359490 A2 11/2003
EP 1359490 A3 11/2003
JP 4-167010 6/1992
KR 0115143 12/2007
WO WO 2004/007719 2/2004

OTHER PUBLICATIONS

Jianping, Zeng, et al, "CMOS Digital Integrated temperature Sensor", IEEE, Aug. 2005, pp. 310-313.
PCT/EP2008/058685 International Search Report and written opinion, Oct. 1, 2008.
PCT/EP2008/051161 International Search Report and written opinion, May 16, 2008.
Chen, Wai-Kai, "The circuits and filters handbook", 2nd ed, CRC Press, 2003.
Cressler, John D., "Silicon Heterostructure Handbook", CRC Press-Taylor & Francis Group, 2006; 4.4-427-438.
Gray, Paul R., et al, *Analysis and Design of Analog Integrated Circuits*, Chapter 4, 4th ed., John Wiley & Sons, Inc., 2001, pp. 253-327.
PCT/EP2005/052737 International Search Report, Sep. 23, 2005.
Banba et al, "A CMOS bandgap reference circuit with Sub-1-V operation", IEEE JSSC vol. 34, No. 5, May 1999, pp. 670-674.
Brokaw, A. Paul, "A simple three-terminal IC bandgap reference", IEEE Journal of Solid-State Circuits, vol. SC-9, No. 6, Dec. 1974, pp. 388-393.
Jones, D.A., and Martin, K., "Analog Integrated Circuit Design", John Wiley & Sons, USA, 1997 (ISBN 0-47L-L4448-7, pp. 353-363).
Malcovati et al, "Curvature-compensated BiCMOS bandgap with 1-V supply voltage", IEEE JSSC, vol. 36, No. 7, Jul. 2001.
Sudha et al, "A low noise sub-bandgap voltage reference", IEEE, Proceedings of the 40th Midwest Symposium on Circuits and Systems, 1997. vol. 1, Aug. 3-6, 1997, pp. 193-196.
Widlar, Robert J., "New developments in IC voltage regulators", IEEE Journal of Solid-State Circuits, Vol. SC-6, No. 1, Feb 1971, pp. 2-7.
PCT/EP2008/067403, International Search Report and Written Opinion, Apr. 27, 2009.
Pease, R.A., "The design of band-gap reference circuits: trials and tribulations", IEEE 1990 Bipolar circuits and Technology Meeting 9.3, Sep. 17, 1990, pp. 214-218.
PCT International Search Report and Written Opinion for PCT/EP2009/053218 mailed on Jan. 8, 2010.
Sanborn et al., 2007, "A Sub-1-V Low-Noise Bandgap Voltage Reference", IEEE Journal of Solid-State Circuits, 42(11):2466-2481.
Xing et al., 2007, "A low voltage high precision CMOS bandgap reference", NORCHIP, 2007 IEEE, pp. 1-4.

* cited by examiner

REFERENCE VOLTAGE CIRCUIT

FIELD OF INVENTION

The present invention relates to a reference voltage circuit which provides a reference voltage with reduced dependencies on semiconductor process variations.

BACKGROUND OF INVENTION

Voltage reference circuits for providing constant voltage references or temperature dependent voltage references are well known in the art. Typically these circuits are provided as bandgap circuits which are designed to operably sum two voltages with opposite temperature slopes so as to provide the output reference voltage. One of the voltages is a Complementary-To-Absolute Temperature (CTAT) voltage typically provided by a base-emitter voltage of a forward biased bipolar transistor whose response is temperature dependent and reduces with increasing temperatures. The other is a Proportional-To-Absolute Temperature (PTAT) voltage which may be typically derived from the base-emitter voltage differences of two bipolar transistors operating at different collector current densities. As a PTAT voltage it will be understood that the output voltage will increase in relation to increasing temperatures. When the summed PTAT voltage and the CTAT voltage are balanced together the voltage is at a first order temperature insensitive. While being advantageous in providing reliable reference voltages and very common within the art, voltage reference circuits provided by traditional bandgap reference voltage circuits are sensitive to semiconductor process variations.

An example of a prior art bandgap reference voltage circuit 100 is illustrated in FIG. 1. This circuit is exemplary of the type of prior art circuitry which is sensitive to process variations. Disadvantages associated with such process variation sensitivities include the fact that the reference voltage generated may vary from process to process, lot to lot and even from die to die in the same wafer. This is obviously not a satisfactory arrangement.

The bandgap reference voltage circuit 100 of FIG. 1 includes a first PNP bipolar transistor Q1 operating at first collector current density and a second PNP bipolar transistor Q2 operating at a second collector current density which is less than that of the first collector current density. The emitter of the first bipolar transistor Q1 is coupled to the inverting input of an operational amplifier A and the emitter of the second bipolar transistor Q2 is coupled via a resistor $r_1$ to the non-inverting input of the amplifier A. A third bipolar transistor Q3 is coupled to a reference voltage node ref via a second resistor $r_2$. The collector current density difference between Q1 and Q2 may be established by having the emitter area of the second bipolar transistor Q2 larger than the emitter area of the first bipolar transistor Q1. Alternatively multiple transistors may be provided in each leg, with the sum of the collector currents of each of the transistors in a first leg being greater than that in a second leg. As a consequence of the differences in collector current densities between the bipolar transistors Q1 and Q2 a base-emitter voltage difference ($\Delta V_{be}$) is developed across the resistor $r_1$.

$$\Delta V_{be} = \frac{kT}{q}\ln(n) = \Delta V_{be}(T_0) * \frac{T}{T_0} \tag{1}$$

Where:

k is the Boltzmann constant;

q is the charge on the electron,

T is operating temperature in Kelvin, $T_0$ is reference temperature, usually room temperature, $\Delta V_{be}(T_0)$ is base-emitter voltage difference at $T_0$, n is the collector current density ratio of Q1 and Q2.

This voltage difference ($\Delta V_{be}$) is of the form of a proportional to absolute temperature (PTAT) voltage. The voltage at the non-inverting input of the amplifier A is related to the base-emitter voltage difference ($\Delta V_{be}$), and as a consequence the amplifier A forces the voltage at the inverting input to be equal to the voltage at the non-inverting input. The output of the amplifier A drives the gates of three PMOS transistors MP1, MP2, and MP3 which are arranged to mirror the PTAT current which flows through $r_1$ such that the drain current of the three PMOS transistors are PTAT.

$$I_p = \frac{\Delta V_{be}}{r_1} = \frac{\Delta V_{be}(T_0)}{r_1} * \frac{T}{T_0} \tag{2}$$

The drain current of MP3 flows through $r_2$ resulting in a PTAT ($\Delta V_{be}$) voltage across $r_2$. The voltage at the reference voltage node ref is the summation of the base-emitter voltage (CTAT) of the bipolar transistor Q3 and the base emitter voltage difference $\Delta V_{be}$ voltage (PTAT) developed across $r_2$ due to the PTAT current from MP3.

$$V_{ref} = V_{be}(Q3) + I_{PTAT} * r_2 = V_{be}(Q3) + \Delta V_{be0} * \frac{T}{T_0} * \frac{r_2}{r_1} \tag{3}$$

It is clear from equation 3 that the reference voltage at node ref has a base-emitter $V_{be}$ component and a base emitter voltage difference $\Delta V_{be}$ component. The $V_{be}$ component is inherently temperature dependent and is also subject to semiconductor process dependencies. Thus, the reference voltage may vary significantly from process to process, lot to lot and even from die to die in the same wafer.

The base-emitter voltage temperature dependence is given by equation 4:

$$V_{be}(T) = V_{G0} - (V_{G0} - V_{be}(T_0)) * \frac{T}{T_0} - m * \frac{kT}{q} * \ln\left(\frac{T}{T_0}\right) + \frac{kT}{q} * \ln\left(\frac{j_c}{j_{c0}}\right) \tag{4}$$

Where:

$V_{G0}$ is an extrapolated bandgap voltage from $T_0$ to 0K, $V_{be}(T_0)$ is the base-emitter voltage at $T_0$, m is a temperature constant, typically denoted as XTI in computer simulation programs, $j_c$ is collector current density at actual temperature, T, and $j_{c0}$ is collector current density at $T_0$.

The first two terms of equation 4 correspond to a linear variation against temperature and the last two terms correspond to a non-linear variation, usually denoted as curvature voltage $V_{curv}$.

$$V_{curv} = -m * \frac{kT}{q} * \ln\left(\frac{T}{T_0}\right) + \frac{kT}{q} * \ln\left(\frac{j_c}{j_{c0}}\right) \tag{5}$$

The reference voltage temperature dependence based on equations 3, 4 and 5 is given by equation 6:

$$V_{ref} = V_{G0} - \left(V_{G0} - V_{be}(T_0) - \Delta V_{be0} * \frac{r_2}{r_1}\right) * \frac{T}{T_0} + V_{curv} \quad (6)$$

To cancel the linear terms in equation 6 it is necessary to arrange that the following condition is met:

$$V_{G0} = V_{be}(T_0) + \Delta V_{be0} * \frac{r_2}{r_1} \quad (7)$$

Then the reference voltage value corresponds to the extrapolated bandgap voltage, $V_{G0}$ plus a small curvature term, $V_{curv}$. One of the main disadvantages of this circuit design is that the reference voltage value corresponds to an unknown parameter, $V_{G0}$, of about 1.1V to 1.22V, with large variation from process to process, lot to lot and even from die to die in the same wafer. This variation is translated into a large spread of the resultant reference voltage values and also of its Thermal Coefficient (TC). In order to compensate for this variation large trimming ranges are required to achieve both the desired absolute value output from the circuit and also and to maintain its TC within desired operating parameters.

There is therefore a need to provide a voltage reference circuit which provides a reference voltage which has less dependency on semiconductor process variations compared to traditional bandgap based reference voltage.

SUMMARY OF INVENTION

These and other problems are addressed by providing a bandgap reference voltage circuit which provides a reference voltage which is based on a PTAT voltage which is substantially less process dependent than a base emitter voltage $V_{be}$. Such a reference voltage circuit may be implemented using an amplifier, a first load element, and a feedback load element. First and second PTAT currents and a CTAT current are arranged such that the generated reference voltage provided at the output of the amplifier is based on a PTAT base-emitter voltage difference $\Delta V_{be}$.

These and other features will be better understood with reference to the followings Figures which are provided to assist in an understanding of the teaching of the invention.

BRIEF DESCRIPTION OF DRAWINGS

The present application will now be described with reference to the accompanying drawings in which.

DETAILED DESCRIPTION OF DRAWINGS

The invention will now be described with reference to some exemplary reference voltage circuits which are provided to assist in an understanding of the teaching of the invention. It will be understood that these circuits are provided to assist in an understanding of benefits that are derivable from following the teaching of the invention and are not to be construed as limiting in any fashion. Furthermore, circuit elements or components that are described with reference to any one Figure may be interchanged with those of other Figures or other equivalent circuit elements without departing from the spirit of the present invention.

Figure 1:
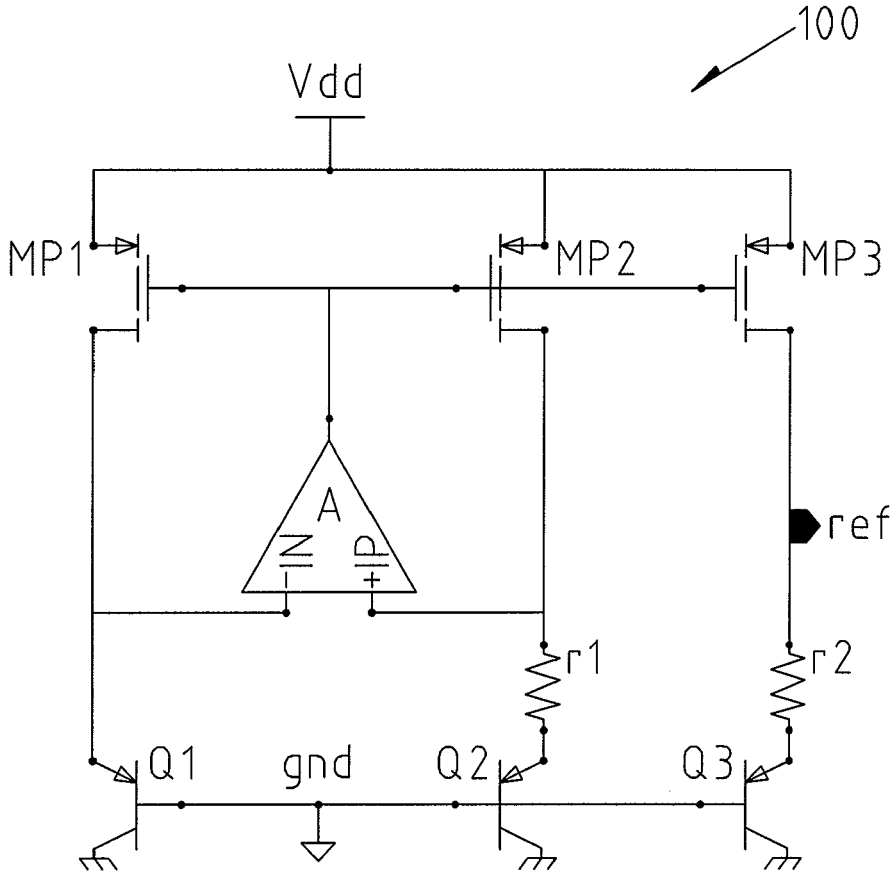
PRIOR ART Fig. 1
FIG. 1 is a schematic circuit diagram of a prior art bandgap voltage reference circuit.
Figure 2:
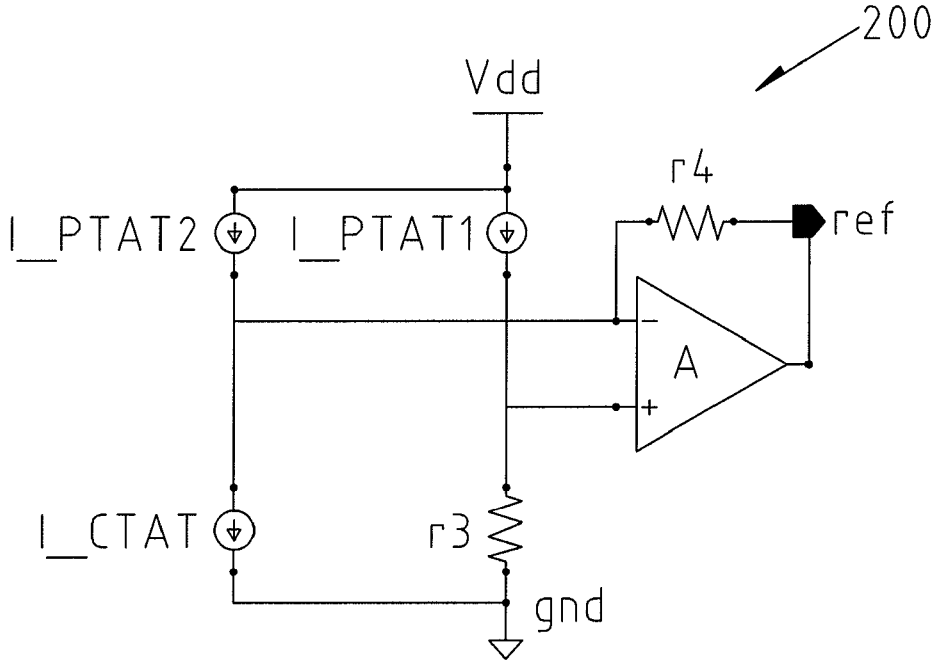
FIG. 2 is a schematic circuit diagram of a circuit provided in accordance with the teaching of the present invention.

Referring to the drawings and initially to FIG. 2 there is illustrated a reference voltage circuit 200 which provides a reference voltage based on a PTAT base-emitter voltage difference $\Delta V_{be}$ rather than the extrapolated bandgap voltage $V_{G0}$. By removing the dependency of the reference voltage to this extrapolated bandgap parameter, such a circuit experiences less process dependencies compared to traditional bandgap voltage reference circuits. The reference voltage circuit 200 comprises an operational amplifier A having an inverting input, non-inverting input and an output. A first load element, namely, resistor $r_3$, is coupled between the non-inverting input of the operational amplifier A and a ground node gnd. A feedback load element, namely resistor $r_4$, is coupled between the inverting input and the output of the amplifier A.

A current biasing circuit arranged between a power supply Vdd and the ground node gnd provides first and second PTAT currents I_PTAT1 and I_PTAT2 and a CTAT current I_CTAT. It will be appreciated that such while referred to in the singular that the current biasing circuit could include individual circuit elements each being configured to generate a specific one of the required PTAT or CTAT currents. In this embodiment, the generated PTAT currents, I_PTAT1 and I_PTAT2, are substantially equal. It will however, be appreciated by those skilled in the art that the individual PTAT currents, I_PTAT1 and I_PTAT2, may be of different values. The first PTAT current I_PTAT1 flows from Vdd to ground through the resistor $r_3$ which results in a corresponding PTAT voltage being developed across $r_3$.

The CTAT current I_CTAT sums with the second PTAT current I_PTAT2 at a summation node common to inverting input of the amplifier A, and the feedback path including the resistor $r_4$. As the CTAT current I_CTAT is of opposite polarity to the second PTAT current I_PTAT2, the resultant current provided at the summation node is a combination of the CTAT element, I_CTAT, subtracted from the PTAT element, I_PTAT2.

By suitably generating the values of the CTAT element, I_CTAT, and the second PTAT element, I_PTAT2, it is possible to generate at a first predetermined temperature a combination of these two currents that will effectively cancel each other out. The resultant current at this predetermined temperature will be zero. While this first predetermined temperature $T_0$ may be chosen to have any temperature value, in this exemplary arrangement, the first predetermined temperature is taken to be room temperature, typically taken to be 25° Celsius but it will be understood that the specific temperature taken is not important in this context.

In operation, the first PTAT current I_PTAT1 (a positive current) flows through $r_3$ resulting in a PTAT voltage dropped across $r_3$. The CTAT current I_CTAT is a negative current, and the second PTAT current I_PTAT2 is a positive current. Thus, at the summation node I_CTAT subtracts from I_PTAT2 which results in zero current at the summation node at room temperature $T_0$. Therefore at room temperature, no current flows through the feedback resistor $r_4$.

At a second predetermined temperature, $T_1$, preferably higher than room temperature, $T_0$, the feedback resistor $r_4$ is set such that the reference voltage remains as it was at the first temperature $T_0$. The output voltage of amplifier A which is the reference voltage for the circuit, corresponds to the voltage applied at the non-inverting input of amplifier A (which is the voltage drop across resistor $r_3$) minus the voltage drop across $r_4$ due to the current difference between I_PTAT2 and I_CTAT. However, at room temperature the current difference between I_PTAT2 and I_CTAT is zero. Thus, the output of the amplifier A is related to the PTAT voltage dropped across $r_3$ resulting from I_PTAT2 flowing through $r_3$. As this is of a PTAT form, it will have a temperature dependency such that the voltage measured at the output of the amplifier can be related to the operating conditions of the circuit.

Figure 3:
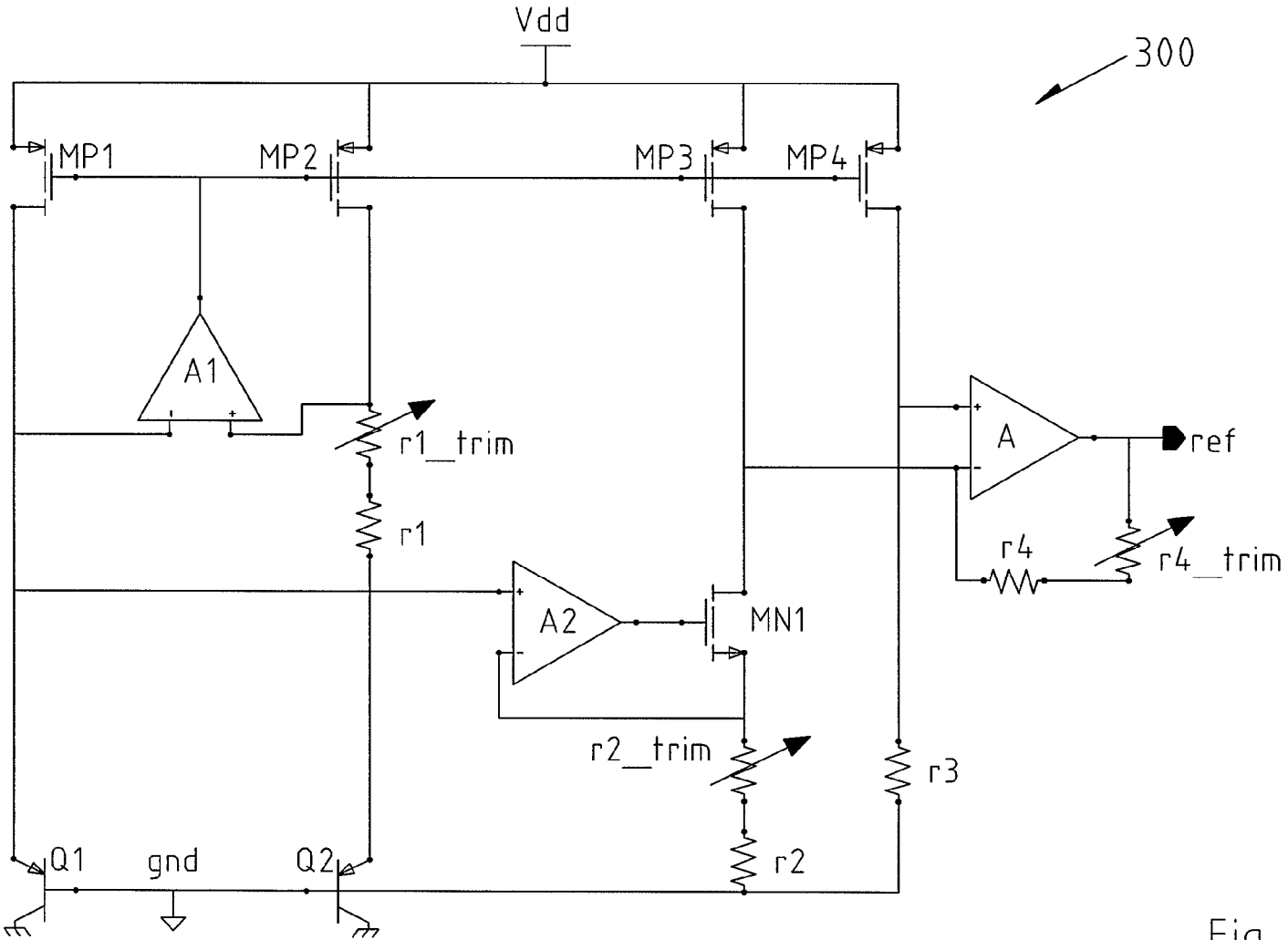
FIG. 3 is a schematic circuit diagram of a circuit provided in accordance with the teaching of the present invention.

Referring now to FIG. 3 there is illustrated another reference voltage circuit 300 provided in accordance with the teaching of the present invention. This circuit includes examples of the type of circuit elements that may be used to generate the PTAT and CTAT currents of FIG. 2 again provides a reference voltage based on a PTAT base-emitter voltage difference $\Delta V_{be}$ rather than the extrapolated bandgap voltage $V_{G0}$. In this way and similarly to the circuit of FIG. 2, the reference voltage output from the circuit of FIG. 3 suffers from less process dependencies compared to traditional bandgap voltage reference.

The reference voltage circuit 300 is substantially similar to the reference voltage circuit 200. The amplifier A, and the resistors $r_3$ and $r_4$ operate in substantially the same manner as described with reference to FIG. 2. Additionally, the resistor $r_4$ is shown has having an explicit trimming element $r_{4_trim}$ which may be trimmed for varying the resistance of $r_4$.

In this arrangement of FIG. 3, specifics of the current biasing circuit that was described with reference to FIG. 2 are shown. In this exemplary arrangement of how such a circuit could be provided, the circuit includes a PTAT current generator which provides the first and second PTAT currents I_PTAT1 and I_PTAT2, and a CTAT current generator which provides the CTAT current. The PTAT current generator comprises a first PNP bipolar transistor Q1 which has its emitter coupled to the non-inverting input of a second operational amplifier (op-amp) A1 and a second PNP bipolar transistor, Q2, which has its emitter coupled to the inverting input of the op-amp A1 via a load element, namely, sense resistor $r_1$. The base and collectors of both the first and second bipolar transistors Q1, Q2 are coupled to the ground node gnd. The emitter area of the second bipolar transistor Q2 is a constant "n" times larger than the emitter area of the first bipolar transistor Q1 such that the collector current density of the first bipolar transistor Q1 is greater than the collector current density of the second bipolar transistor Q2. As was described above with reference to a typical known bandgap reference voltage circuit such differences in collector current density may be achieved in any one of a number of different ways and it is not intended to limit the teaching of the present invention to any one specific arrangement. The sense resistor $r_1$ includes a trimming element $r_{1_trim}$ which may be trimmed for varying the resistance of the sense resistor $r_1$.

Due to the collector current density difference between the first bipolar transistor Q1 and the second bipolar transistor Q2, a base emitter voltage difference, $\Delta V_{be}$, is developed across the sense resistor $r_1$ resulting in a PTAT current which biases the second bipolar transistor Q2. The PTAT current derived from the base emitter voltage difference, $\Delta V_{be}$, may be varied by trimming the trimming element $r_{1_trim}$ of the sense resistor $r_1$. The output of the amplifier A1 drives a current mirror arrangement comprising four PMOS transistors MP1, MP2, MP3, and MP4 for mirroring the PTAT current derived from the $\Delta V_{be}$. The four PMOS transistors of the current mirror have the same aspect ratios "Width" and "Length" W/L and each having their gates coupled to the output of the amplifier A1 and their sources coupled to the power supply Vdd. As a result their drain currents are substantially equal to the PTAT current derived from the $\Delta V_{be}$ arising from the collector current density differences between the first and second bipolar transistors Q1 and Q2. The drain current of MP4 provides the first PTAT current I_PTAT1, and the drain current of MP3 provides the second PTAT current I_PTAT2. As the MOS devices are substantially equivalent to one another, each of the two PTAT currents are also substantially equal. Similarly, the drain current of MP1 which biases the first bipolar transistor Q1 is a PTAT current and is substantially equal to I_PTAT1 and I_PTAT2.

The CTAT current generator comprises an operational amplifier A2 having an inverting input, non-inverting input and an output. The non-inverting input of the amplifier A2 is coupled to the emitter of the first bipolar transistor Q1 so that a base emitter voltage $V_{be}$ is applied to the non-inverting input of the amplifier A2. A sense resistor $r_2$ is coupled between the inverting input of the amplifier A2 and the ground node gnd. The output of the amplifier A2 drives the gate of an NMOS transistor MN1 which has its source coupled to the sense resistor $r_2$ and its drain coupled to the summation node which is also coupled to the drain of the PMOS transistor MP3 which provides the second PTAT current I_PTAT2. The amplifier A2 forces the voltage on its inverting input to be equal to the voltage at its non-inverting input. Thus, the voltage at the inverting input of A2 is equal to the base emitter voltage of Q1. Therefore a base emitter voltage $V_{be}$ is dropped across $r_2$ which results in a CTAT current I_CTAT flowing through $r_2$. The NMOS transistor MN1 mirrors the CTAT current I_CTAT. As the second PTAT current I_PTAT2 is provided by a PMOS transistor, and the CTAT current I_CTAT is provided by an NMOS transistor I_CTAT is of opposite polarity to I_PTAT2. At the summation node which is common to the drains of MP3, MN1 and the inverting input of the amplifier A2 I_CTAT subtracts from I_PTAT2.

The operation of reference voltage circuit 300 is substantially similar to that of the reference voltage circuit 200. The first PTAT current I_PTAT1 flows through resistor $r_3$ resulting in a PTAT, $\Delta V_{be}$, voltage dropped across $r_3$. The CTAT current I_CTAT is a negative current, and the second PTAT current I_PTAT2 is a positive current. At room temperature I_CTAT and I_PTAT2 are generated to be of equal magnitude and opposite in polarity and as a result at the summation node I_CTAT subtracts from I_PTAT2 which results in zero current flowing through the feedback resistor $r_4$.

At room temperature the zero difference between I_PTAT2 and I_CTAT corresponds to:

$$\frac{\Delta V_{be}(T_0)}{r_1} = \frac{V_{be}(T_0)}{r_2} \text{ or } V_{be}(T_0) = \Delta V_{be}(T_0) * \frac{r_2}{r_1} \tag{9}$$

For a zero offset voltage amplifier the output voltage, which is the reference voltage, corresponds to the voltage applied at the non-inverting input of amplifier A minus the voltage drop across $r_4$ due to the current difference between I_PTAT2 and I_CTAT.

$$V_{ref} = I_{PTAT1} * r_3 - (I_{PTAT2} - I_{CTAT}) * r_4 = \Delta V_{be}(T_0) * \frac{T}{T_0} * \frac{r_3}{r_1} - \Delta V_{be}(T_0) * \frac{T}{T_0} * \frac{r_4}{r_1} + V_{g0} * \frac{r_4}{r_2} - [V_{g0} - V_{be}(T_0)] * \frac{T}{T_0} * \frac{r_4}{r_2} - V_{curv} * \frac{r_4}{r_2} \quad (10)$$

The reference voltage $V_{ref}$ can be separated in three terms as given by equation 11, namely, a temperature independent term, a linear temperature dependent term, and a curvature term.

$$V_{ref} = V_{g0} * \frac{r_4}{r_2} + \frac{T}{T_0} * \left\{\Delta V_{be}(T_0) * \left(\frac{r_3}{r_1} - \frac{r_4}{r_1}\right) - \left[V_{g0} - \Delta V_{be}(T_0) * \frac{r_2}{r_1}\right] * \frac{r_4}{r_2}\right\} - V_{curv} * \frac{r_4}{r_2} \quad (11)$$

In order to get a temperature insensitive voltage from equation 11 a second condition needs to be set which is given by equation 12.

At a second predetermined temperature, preferably higher than the first predetermined temperature, the feedback resistor $r_4$ is set such that the reference voltage remains as it was at the first temperature $T_0$.

$$\Delta V_{be}(T_0) * \left(\frac{r_3}{r_1} - \frac{r_4}{r_1}\right) - \left[V_{g0} - \Delta V_{be}(T_0) * \frac{r_2}{r_1}\right] * \frac{r_4}{r_2} = 0 \quad (12)$$

Thus:

$$\Delta V_{be}(T_0) * \frac{r_3}{r_1} = V_{g0} * \frac{r_4}{r_2} \text{ or } V_{g0} = \Delta V_{be}(T_0) * \frac{r_3}{r_1} * \frac{r_2}{r_4} \quad (13)$$

Now incorporating equations 9 and 13 into equation 11 results in:

$$V_{ref} = \Delta V_{be}(T_0) * \frac{r_3}{r_1} - V_{curv} * \frac{r_4}{r_2} \quad (14)$$

It will be appreciated that, the voltage curvature term $V_{curv}$ of the reference voltage circuit 300 has the same form as the voltage reference as in the prior art circuit 100. This second order curvature effect can be compensated for using suitable circuitry. As equation 14 shows the voltage reference at the output of the amplifier A is related to the base-emitter voltage difference $\Delta V_{be}$ at room temperature and a resistor ratio. Both terms can be set with high accuracy and they have very little process dependence. Advantageously, the voltage reference can be scaled to any value by scaling the resistor ratio $r_3/r_1$.

It will be recalled that the teaching of the present invention provides for, at a first temperature, for the values of the CTAT and first PTAT element to substantially cancel each other. In the arrangement of FIG. 3, a trimming resistor, $r_{2_trim}$, is provided to allow for an adjustment of the CTAT current I_CTAT such that at room temperature, $T_0$, the injected current into the feedback resistor $r_4$ is zero. In this way, the first condition corresponding to zero feedback current, according to equation 9 is set by trimming $r_{2_trim}$.

The second condition, corresponding to providing the temperature insensitivity according to equation 12 may be effected by trimming the resistance in the feedback path of the amplifier A by trimming $r_{4_trim}$.

The trimming procedure for the reference voltage circuit 300 may be provided as follows. At a first temperature typically room temperature, $T_0$, variable resistor $r_{1_trim}$ (which can be provided in one of a number of different forms such as a string DAC) is adjusted such that the voltage measured at the inverting input of the amplifier A has the desired value. At the same temperature, $T_0$, $r_{2_trim}$ is adjusted such that the measured voltages at the inverting input and at the output of the amplifier A are the same. At a second temperature, $T_1$, which is desirably higher than the first temperature $T_0$, $r_{4_trim}$ is adjusted the so that the reference voltage at the output of the amplifier A remains as it was at the first temperature $T_0$.

Figure 4:
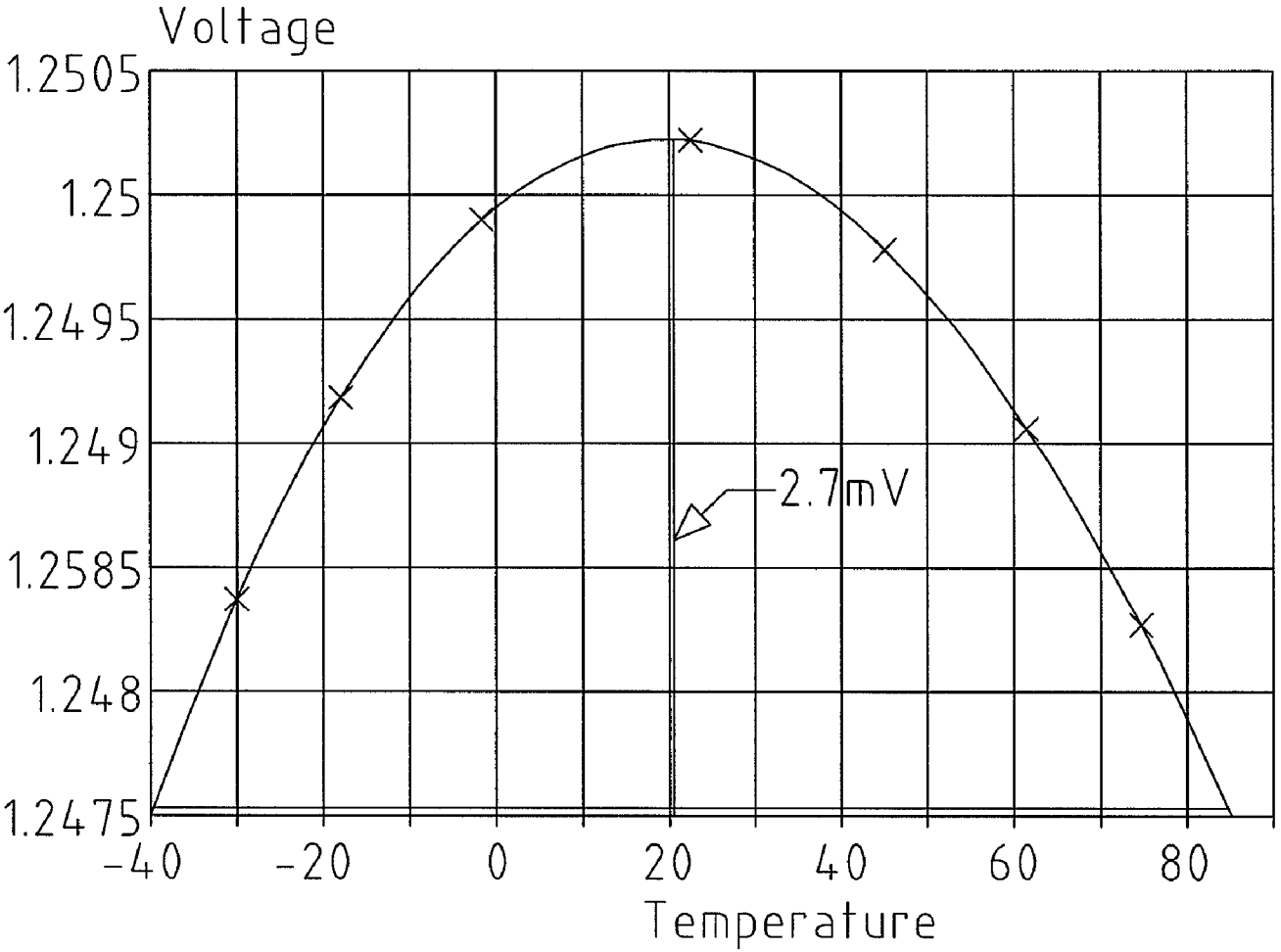
FIG. 4 is a graph showing the simulated reference voltage of the circuit of FIG. 2 against temperature.

Referring now to the graph of FIG. 4 which shows exemplary performance of the reference voltage of reference voltage circuit 300 plotted against temperature for the industrial temperature range (−40° C. to 85° C.). I_PTAT1, I_PTAT2 and I_CTAT were set to about 2 μA at room temperature of 25° C. As the graph illustrates the reference voltage is about 1.25V with a bow of about 2.7 mV which corresponds to a temperature coefficient, TC, of 17 ppm/° C., using "box method," very similar to a voltage reference based on the bandgap principle. As was mentioned above, different solutions can be used to correct for the curvature error shown in the graph of FIG. 4.

Figure 5:
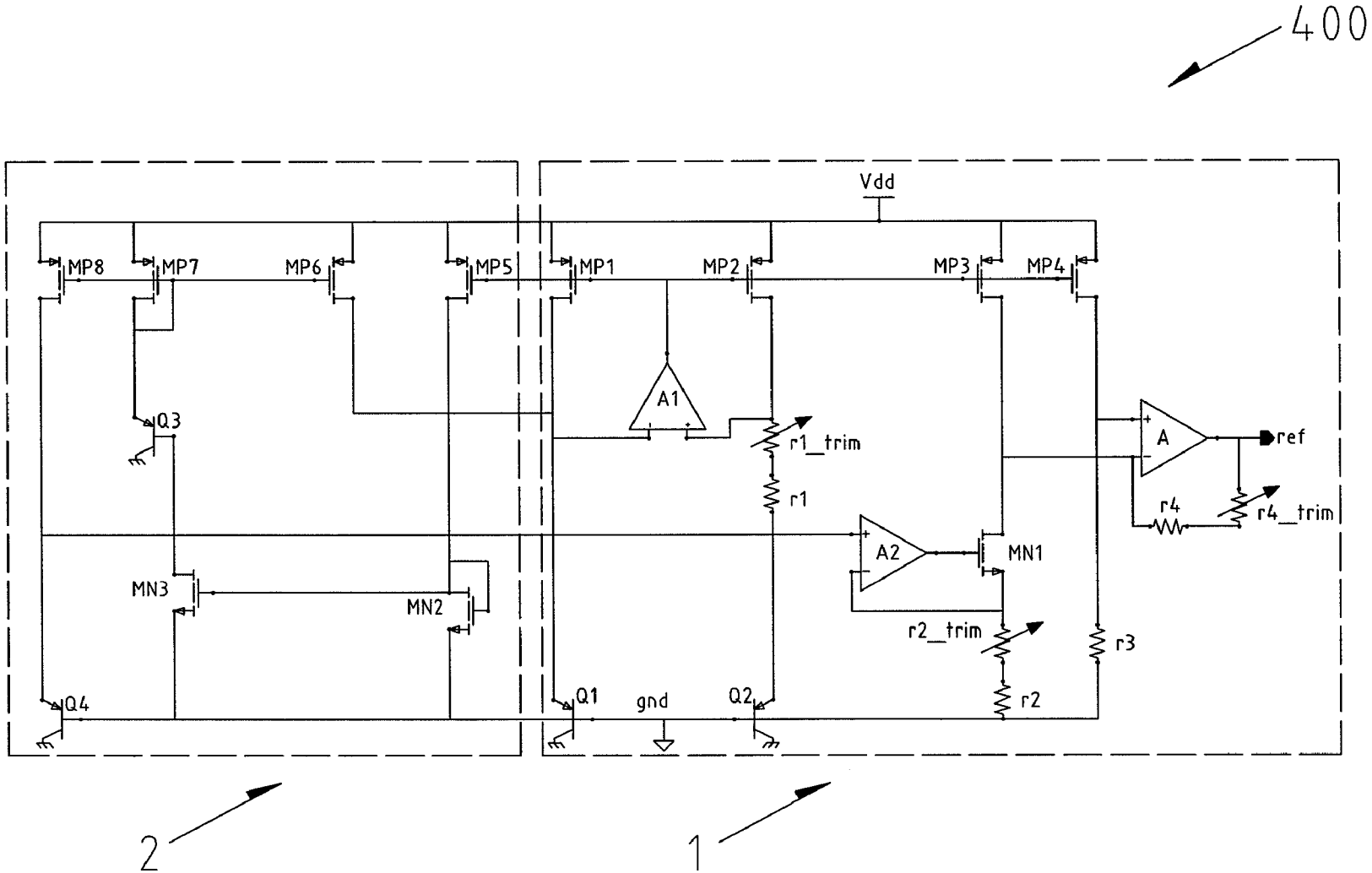
FIG. 5 is a schematic circuit diagram of a circuit provided in accordance with the teaching of the present invention.

Referring now to FIG. 5 a reference voltage circuit 400 is provided which is substantially similar to the reference voltage circuit 300 with the same components referenced by the same reference labels. The reference voltage circuit 500 incorporates the reference voltage circuit 400 indicated by reference numeral 1 and a curvature compensation circuit indicated by reference numeral 2 which compensates for the curvature error.

The purpose of the curvature compensation circuit 2 is to force a current with exponential temperature dependence into the emitter of the bipolar transistor Q1 the base emitter voltage of which is used to generate the CTAT current I_CTAT and to add a similar smaller current into the emitter of the high current density bipolar transistor Q2 from the PTAT current generator. A PTAT current is mirrored via a PMOS transistor MP5 and an NMOS transistor MN2. A fraction of the mirrored PTAT current is pulled via the NMOS transistor MN3 from the base terminal of a bipolar transistor Q3. The emitter current of Q3 results in an exponential temperature dependent current which is mirrored via a PMOS transistor MP5 into the emitter of Q1 and via the PMOS transistor MP8 into the emitter of a bipolar transistor Q4. The base-emitter voltage of Q4 is then used to generate the CTAT current.

Figure 6:
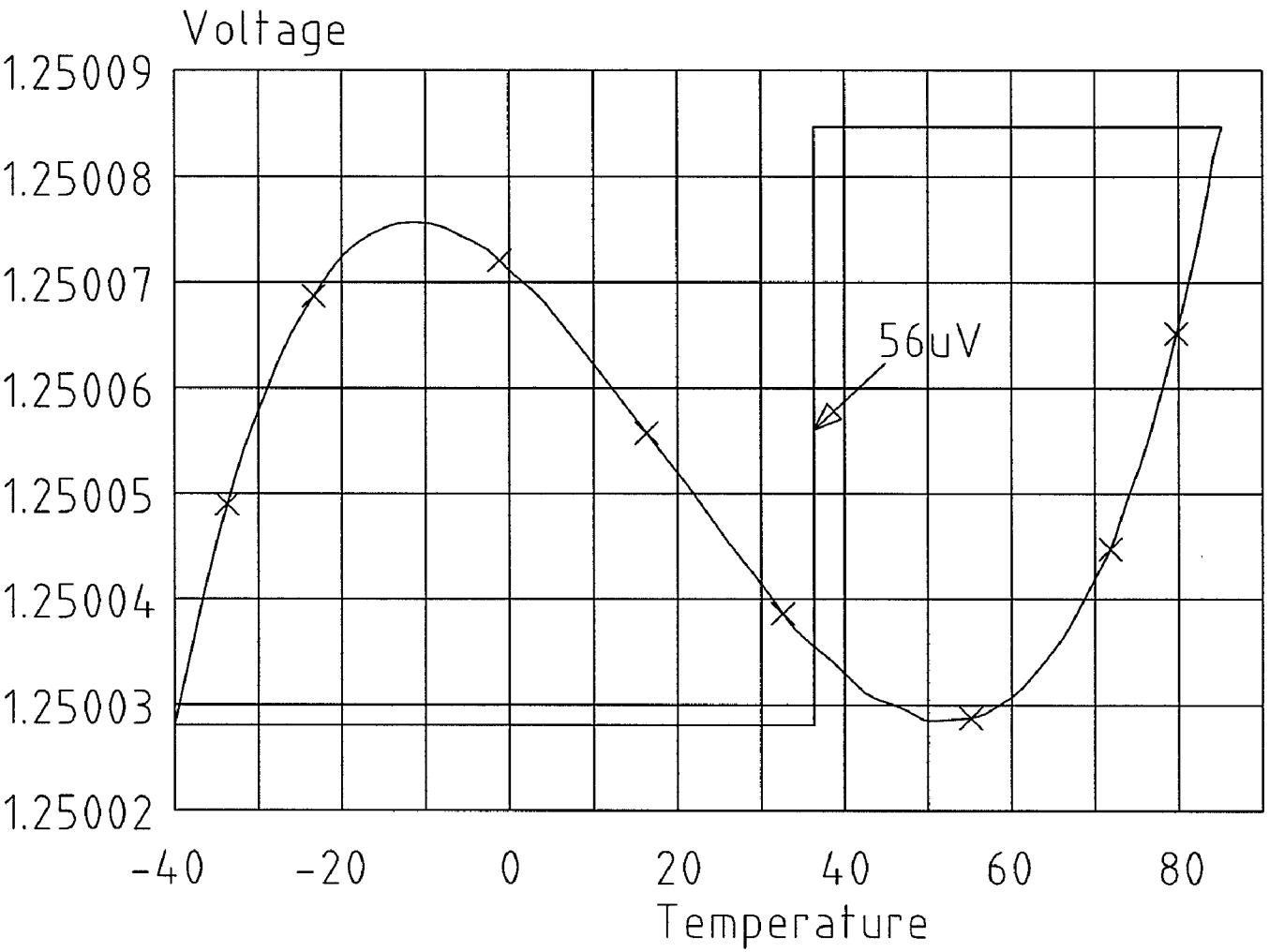
FIG. 6 is a graph showing the simulated reference voltage of the circuit of FIG. 5 against temperature.

Referring now to FIG. 6 which shows exemplary performance of the reference voltage of reference voltage circuit 400 plotted against temperature for the industrial temperature range (−40° C. to 85° C.). I_PTAT1, I_PTAT2 and I_CTAT were set to about 2 μA at room temperature of 25° C. The residual curvature is 56 μV which corresponds to a TC of 0.35 ppm/° C. or about fifty times improvement compared to the uncorrected reference voltage circuit 300.

It will be understood that what has been described herein are exemplary embodiments of circuits which have many advantages over reference voltage circuit known heretofore. The main advantage of the exemplary embodiments is that the reference voltage is based on a very predictable voltage, namely, a base-emitter voltage difference. A further advantage is that the reference voltage has much less dependency on process variations compared to bandgap based voltage reference. Another advantage is that the reference voltage can be scaled to any voltage value via a resistor ratio. A further advantage is that the reference voltage may be trimmed easy and with high accuracy.

While the present invention has been described with reference to exemplary arrangements and circuits it will be understood that it is not intended to limit the teaching of the present invention to such arrangements as modifications can be made without departing from the spirit and scope of the present invention. In this way it will be understood that the invention is to be limited only insofar as is deemed necessary in the light of the appended claims.

It will be understood that the use of the term "coupled" is intended to mean that the two devices are configured to be in electric communication with one another. This may be achieved by a direct link between the two devices or may be via one or more intermediary electrical devices.

Similarly the words "comprises" and "comprising" when used in the specification are used in an open-ended sense to specify the presence of stated features, integers, steps or components but do not preclude the presence or addition of one or more additional features, integers, steps, components or groups thereof.

I claim:

1. A reference voltage circuit comprising:

a first amplifier having an inverting input, a non-inverting input and an output, a current biasing circuit with a first potential and a second potential, the current biasing circuit for providing first and second PTAT currents from the first potential to the second potential and a CTAT current also from the first potential to the second potential; the CTAT current being equal in value to the second PTAT current at a first predetermined temperature, a first load element associated with one of the inputs of the first amplifier and arranged for receiving the first PTAT current such that a PTAT voltage is developed across the first load element and is available from the output of the first amplifier at the first predetermined temperature, and a feedback load element coupled between one of the inputs and the output of the first amplifier for receiving the summation of the CTAT current and the second PTAT current; the resistance of the feedback load element being such that at a second predetermined temperature the voltage at the output of the first amplifier is substantially equal to the voltage at the output of the first amplifier at the first predetermined temperature.

2. A reference voltage circuit as claimed in claim 1, wherein the current biasing circuit comprises a PTAT current generator for providing the first and second PTAT currents, and a CTAT current generator for providing the CTAT current.

3. A reference voltage circuit as claimed in claim 2, wherein the PTAT current generator comprises a second amplifier having an inverting input, a non-inverting input and an output, and at least first and second bipolar transistors operable at different collector current densities and each being associated with a corresponding one of the inverting and non-inverting inputs of the second amplifier.

4. A reference voltage circuit as claimed in claim 3, wherein the PTAT current generator further comprises a first sense load element coupled between one of the inputs of the second amplifier and the second bipolar transistor such that a base emitter voltage difference ΔVbe is developed across the first sense load element from which the first and second PTAT currents are derived.

5. A reference voltage circuit as claimed in claim 4, comprising a summation node and wherein the PTAT current generator further comprises a current mirror arrangement for providing the first PTAT current to the first sense load element, and the second PTAT current to the summation node where the second PTAT current is summed with the CTAT current.

6. A reference voltage circuit as claimed in claim 5, wherein the current mirror arrangement is also configured for biasing the first and second bipolar transistors with the PTAT current derived from the ΔVbe developed across the first sense load element.

7. A reference voltage circuit as claimed in claim 6, wherein the current mirror arrangement comprises a plurality of PMOS devices the gates of which are driven by the output of the second amplifier.

8. A reference voltage circuit as claimed in claim 7, wherein the drain of one of the PMOS transistors is coupled to the first sense load element and one of the inputs of the second amplifier.

9. A reference voltage circuit as claimed in claim 6, wherein the current mirror arrangement comprises four PMOS transistors.

10. A reference voltage circuit as claimed in claim 4, wherein the first sense load element comprises a trimming element for varying the resistance of the first sense load element.

11. A reference voltage circuit as claimed in claim 5, wherein the CTAT current generator comprises a third amplifier having an inverting input, a non-inverting input and an output, the emitter of the first bipolar transistor is coupled to one of the inputs of the third amplifier.

12. A reference voltage circuit as claim in claim 11, wherein the CTAT current generator further comprises a second sense resistor coupled to the other one of the inputs of the third amplifier.

13. A reference voltage circuit as claimed in claim 12, wherein the CTAT current generator further comprises an NMOS transistor the gate of which is driven by the output of the third amplifier, the source of the NMOS transistor is coupled to the second sense load element and the drain of the NMOS transistor is coupled to the drain of one of the PMOS transistors of the mirror arrangement.

14. A reference voltage circuit as claimed in claim 13, wherein the summation node is common to the drain of the NMOS transistor, the drain of the PMOS transistor which is coupled to the NMOS, the inverting input of the first amplifier, and one end of the feedback load element.

15. A reference voltage circuit as claimed in claim 14, wherein the second sense load element comprises a trimming element which may be trimmed for varying the resistance of the second sense load element.

16. A reference voltage circuit as claimed in claim 1, wherein the feedback load element comprises a trimming element which may be trimmed for varying the resistance of the feedback load element.

17. A reference voltage circuit as claimed in claim 6, wherein the circuit further comprises a compensation circuit for correcting curvature error.

18. A reference voltage circuit as claimed in claim 17, wherein the compensation circuit is configured for providing current with exponential temperature dependence into the emitter of the first and second bipolar transistors.

19. A reference voltage circuit as claimed in claim 18, wherein the exponential temperature dependence current provided by compensation circuit into the emitter of the first bipolar transistor is greater than the exponential temperature dependence current provided by the compensation circuit into the emitter of the second bipolar transistor.

20. A reference voltage circuit as claimed in claim 18, wherein the compensation circuit comprises at least one bipolar transistor for providing the current with exponential temperature dependence.

21. A reference voltage circuit as claimed in claim 1, wherein the second predetermined temperature is greater than the first predetermined temperature.

22. A reference voltage circuit comprising:

an amplifier having an inverting input, a non-inverting input and an output, a PTAT current generator for providing first and second PTAT currents from a first potential to a second potential, a first load element associated with one of the inputs of the amplifier and arranged for receiving the first PTAT current such that a PTAT voltage is developed across the first load element and is available from the output of the amplifier at the first predetermined temperature, a CTAT current generator for providing a CTAT current from the first potential to the second potential; the CTAT current being equal in value to the second PTAT current at a first predetermined temperature, and a feedback load element coupled between one of the inputs and the output of the amplifier for receiving the summation of the CTAT current and the second PTAT current; the feedback load element having a resistance such that at a second predetermined temperature the voltage at the output of the amplifier is substantially equal to the voltage at the output of the amplifier at the first predetermined temperature.

23. A method of generating a reference voltage, the method comprising the steps of:

providing a amplifier having an inverting input, a non-inverting input and an output;

providing first and second PTAT currents from a first potential to a second potential and a CTAT current from the first potential to the second potential;

adjusting one of the CTAT current and the second PTAT current such at a first predetermined temperature the CTAT current and the second PTAT current are equal in value;

coupling a first load element to the non-inverting input of the amplifier and arranging the first load element for receiving the first PTAT current such that a PTAT voltage is developed across the first load element and is available from the output of the amplifier at the first predetermined temperature;

coupling a feedback load element between the inverting input and the output of the amplifier for receiving the summation of the CTAT current and the second PTAT current; and varying the resistance of the feedback load element such that at a second predetermined temperature the voltage at the output of the amplifier is substantially equal to the voltage at the output of the amplifier at the first predetermined temperature.

24. A method as claimed in claim 23, wherein the first and second PTAT currents are generated by a PTAT current generator having a trimming element, and the CTAT current is generated by a CTAT current generator having a trimming element, the method further includes the steps of:

trimming the trimming element of the PTAT current generator for varying at least one of the PTAT currents such that the voltage at the inverting input of the amplifier has a predetermined value at a first predetermined temperature; and trimming the trimming element of the CTAT current generator for varying the CTAT current such that the voltages at the inverting input and at the output of the amplifier are substantially equal at the first predetermined temperature.

* * * * *